US005662321A

United States Patent [19]

Borostyan et al.

[11] Patent Number: 5,662,321

[45] Date of Patent: Sep. 2, 1997

[54] AUTOMATIC DOCUMENT FEEDER WITH SKEW CONTROL

[75] Inventors: Stephen Borostyan, 945 Raccoon Run, Victor, N.Y. 14564; David M. Borostyan, 706 Stone Cove, Newport News, Va. 23602

[73] Assignees: Stephen Borostyan, Victor, N.Y.; David M. Borostyan, Newport News, Va.

[21] Appl. No.: 541,949

[22] Filed: Oct. 10, 1995

Related U.S. Application Data

[60] Provisional application No. 60/000,258, Jun. 15, 1995.

[51] Int. Cl.[6] ..... B65H 5/00

[52] U.S. Cl. ..... 271/10.03; 271/10.12; 271/228; 271/258.01; 271/261; 271/265.02; 271/265.03; 271/272; 271/145; 271/902

[58] Field of Search ..... 271/10.03, 10.09, 271/10.11, 10.12, 10.08, 227, 228, 258.01, 261, 265.02, 265.03, 272, 145, 902, 121, 122

[56] References Cited

U.S. PATENT DOCUMENTS

| | | | |
|---|---|---|---|
| 3,195,887 | 7/1965 | Bean . | |
| 3,272,500 | 9/1966 | Van Dalen et al. . | |
| 3,952,866 | 4/1976 | Leloux . | |
| 4,208,046 | 6/1980 | Shimizu . | |
| 4,239,203 | 12/1980 | Uchida . | |
| 4,248,416 | 2/1981 | Seib . | |
| 4,334,759 | 6/1982 | Clausing . | |
| 4,436,298 | 3/1984 | Donner et al. | 271/10.12 |
| 4,483,530 | 11/1984 | Spencer et al. . | |
| 4,506,878 | 3/1985 | Bashford . | |
| 4,558,373 | 12/1985 | Plasencia et al. . | |
| 4,607,833 | 8/1986 | Svyatsky et al. . | |
| 4,674,735 | 6/1987 | DuBois et al. . | |
| 4,855,607 | 8/1989 | Eckl | 271/227 |
| 4,877,234 | 10/1989 | Mandel . | |
| 4,927,130 | 5/1990 | Tanaka | 271/10.11 |
| 4,984,779 | 1/1991 | Iwasaki . | |
| 5,192,067 | 3/1993 | Saito | 271/10.03 |
| 5,219,159 | 6/1993 | Malachowski et al. . | |
| 5,292,112 | 3/1994 | Hirota et al. | 271/145 |

FOREIGN PATENT DOCUMENTS

| | | | |
|---|---|---|---|
| 0036122 | 2/1991 | Japan | 271/145 |
| 406001498 | 1/1994 | Japan | 271/227 |

*Primary Examiner*—H. Grant Skaggs
*Attorney, Agent, or Firm*—Eugene Stephens & Associates

[57] ABSTRACT

The disclosed document feeder apparatus includes a document drive that comprises only a single line of feed rollers with a simple skew adjustment system. This drive is shown incorporated in a cassette-loaded automatic document feeder ("ADF") that is attachable to an existing independent engineering document copier in a non-intrusive manner. The cassette can be loaded, either when positioned in the ADF or at a location remote from the ADF, with a stack of large engineering documents of mixed media and varying sizes; and it is even possible for the cassette to carry a document several yards (meters) long. Documents are fed serially from the top of the stack through the ADF's document flow path by the document drive which is centered for alignment along a line positioned parallel to the document flow path. A speed control assembly, all parts of which are located within the ADF itself, adjusts the speed of the document in the ADF feed rollers to match the speed of the independent copier's constant velocity transport. The leading edge of each successive document is sensed and, if not perpendicular to the flow path, is correctly realigned by the skew adjustment system that momentarily reorients one of the ADF's in-line feed rollers to an adjustment position that is slightly out of angular alignment with the feed roller center line.

22 Claims, 4 Drawing Sheets

AUTOMATIC DOCUMENT FEEDER WITH SKEW CONTROL

This application claims the benefit of U.S. Provisional application Ser. No. 60/000,258, filed on 15 Jun. 1995, and that Provisional Application is hereby incorporated by reference.

TECHNICAL FIELD

The invention relates to apparatus for automatically feeding documents and to such automatic document feeding apparatus used for delivering documents to an independent processing machine, e.g., an engineering document copier.

BACKGROUND OF INVENTION

Machines used to copy, print, or otherwise process sheet documents must include means for properly aligning the individual documents before they are processed. Sheet documents may be skewed out of proper alignment when initially loaded into the processing machine by an operator, or the documents may become skewed during their passage through the machine's document flow path. Therefore, sheet-processing machines usually provide some form of "skew control" means to assure proper alignment when the document is fed into the machine's processing station.

[NOTE: As used herein, the term "document" refers generally to a single sheet of paper, plastic laminate, or similar sheet material used to record information.]

In sheet processing machines known to us, the most common method of achieving proper sheet alignment is "edge" registration wherein drive rollers direct one side of the document against a registration wall or flange (e.g., see U.S. Pat. No. 4,483,530 issued to Spencer et al. and U.S. Pat. No. 4,877,234 issued to Mandel). However, other known sheet processing machines achieve proper sheet alignment by using a "center" registration method wherein skew is recognized by sensing the leading edge of the document which is then moved until it is properly aligned in the exact center of the document flow path. Examples of the latter method can be found in U.S. Pat. No. 3,952,866 (Leloux), in which the document is captured and centered by a plurality of needles, and also in U.S. Patent No. 5,219,159 (Malachowski et al.) in which the document is secured by stalled rollers that are then moved transverse to the document flow path to achieve appropriate centering. Such known registration systems are mechanically complex and relatively expensive to manufacture, assemble, and service.

Machines used to copy engineering-size documents (as different from conventional letter-size documents) have document feeding and transport mechanisms that require the operator to manually insert the document to be copied. While such manual handling is time consuming and expensive, it has been accepted as necessary because drawings and other engineering documents are recorded on a variety of materials and come in such large and varied sizes. For example, the sheet materials often vary in thickness, while also varying in widths ranging from 8 inches (20 cm) to 3 feet (90 cm), and varying even more in length, with some drawings coming in large rolls having lengths measuring several yards (meters).

These large variations in engineering document parameters make document loading, reliable feeding, and separation of documents very difficult; and deskewing is particularly difficult because the beam strength of thin sheet material is significantly reduced as the width of the sheet increases. Therefore, proper registration and skew control is particularly important in machines used for processing these variably-sized engineering documents. All of these problems have heretofore prevented the development of commercially-acceptable automatic document feeder ("ADF") apparatus for processing engineering-type documents.

SUMMARY OF THE INVENTION

In its most preferred embodiment, our invention is a cassette-loaded ADF that is easily attached to an existing engineering document copier in a non-intrusive manner. That is, our ADF does not affect the operation or circuitry of the independent document processing machine to which it is attached. The cassette can be loaded with a plurality of large engineering documents of mixed media and varying sizes, the cassette having a cover with a plurality of spaced fingers and marked with guidelines to facilitate positioning of each individual document as it is being stacked in a manner appropriate to the registration method used by the independent processor to which the documents are being fed. The operator can stack documents in the cassette when the cassette is in the ADF, or such loading can take place at a location remote from the ADF.

When slipped into operating position in the ADF, the cassette locates the leading edges of its stacked documents at the entrance to the ADF's document flow path; and a single, weighted roller, which is mounted in the cassette, presses on the top document of the stack of loaded documents to maintain their alignment as they are fed serially from the top of the stack. The documents are fed through the ADF by a document drive comprising a single row of feed rollers centered for alignment along a line positioned parallel to the document flow path, the single row of rollers being aligned above and below the flow path.

In the disclosed preferred embodiment, documents pass serially through two separate document separation systems: An initial separation system comprising a nudger roller and a conventional retard pad is positioned at the entrance of the flow path for separating the top document stacked in the cassette. Following this initial separation, documents moving along the flow path are next received in the nip between a drive roller and a brake roller. The latter rollers serve the triple function of (a) providing further document separation, should that be necessary; (b) delivering the leading edge of the document into the nip between a pair of take-away rollers; and (c) acting as a document "pivot" when the document is rotated for skew correction. However, for some applications, the invention requires only a single separation system to accomplish these three enumerated functions. That is, either a nudger roller/retard pad or a drive roller/brake roller may be sufficient.

After passing between the take-away rollers, the leading edge of the document is then moved downstream through a gate at the exit of the ADF flow path and into a nip formed between an idler roller, which is preferably part of the ADF, and a constant velocity transport ("CVT") roller that is part of the feeding mechanism of the independent engineering copier to which the ADF is attached.

Each successive set of ADF feed rollers drives the document at successively greater speeds. That is, the drive roller rotates faster than the nudger roller, and the take-away roller rotates faster than the drive roller. However, each of the successive rollers is driven by an over-drive clutch, permitting each roller to be rotated faster as the leading edge of the document is accelerated by each of the succeeding sets of rollers. Although overdriven, each preceding roller set creates a slight drag on the document, keeping the surface of the document in tension between each successive set. The ADF take-away roller speed matches the speed of the CVT drive roller of the independent copier machine.

During the feeding of each individual document, the leading edge of the document is sensed upstream of the take-away rollers and, if not perpendicular to the flow path, is correctly realigned by a special skew adjustment mechanism. The latter mechanism moves the take-away rollers from a first position (in alignment with the feed roller center line) to either of two adjustment positions in which the rollers are reoriented out of alignment with the feed roller center line in the plane of the flow path by predetermined angles (e.g., ±3°). The take-away rollers are thereafter returned to their normal in-line orientation following a time period selected by an algorithm or by a "look-up" table in accordance with the amount of skew noted by the skew sensing assembly. Preferably, a second set of sensors, downstream of the take-away rollers (but upstream of the flow path exit), again senses the alignment of the document's leading edge; and the adjustment mechanism again momentarily reorients the take-away rollers, should such further skew adjustment appear necessary.

Respective speed sensors track (a) the speed of the document in the ADF flow path and (b) the speed of the independent copier's CVT. These sensed speed signals are compared, and the speed of the ADF's document drive is continually adjusted to match its speed to the speed of the independent copier's CVT.

The primary features of our invention are its document drive, comprising only a single line of feed rollers, and its simple skew control. These features are particularly appropriate for the disclosed preferred embodiment which feeds a variety of differently-sized documents to an engineering copier. However, these primary features are also appropriate for incorporation in the ADF portions of other document processing equipment, e.g., conventional high speed copiers for letter-size documents.

DRAWINGS

DETAILED DESCRIPTION OF THE INVENTION

Figure 1:
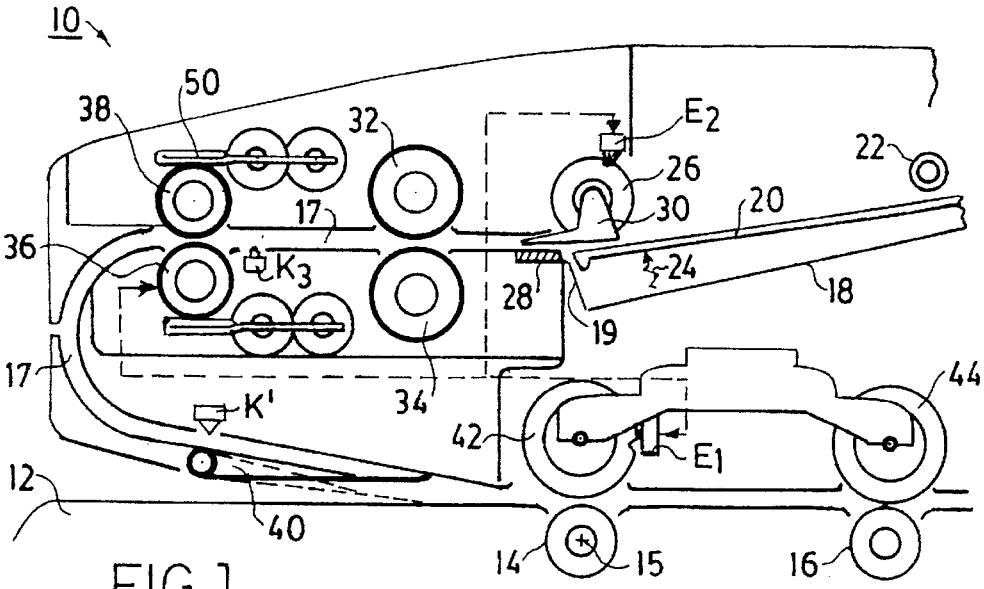
FIG. 1 is a schematic diagram of the document flow path of an ADF according to the invention; this diagram includes most of the flow path illustrated in FIG. 2 when viewed in the plane 1—1 as indicated in FIG. 2.

FIG. 1 is a schematic side view of the front portion of our ADF 10 attached to the constant velocity transport ("CVT") portion of an independent engineering copier 12 (only a very small section of the uppermost portion of copier 12 is shown). In a manner well known in the art, the CVT portion of copier 12 includes a set of rollers 14, 16 for moving a document across an imaging station (light lens or digital) at a constant velocity. CVT roller 14 rotates about its axis 15.

Document Drive

Figure 2:
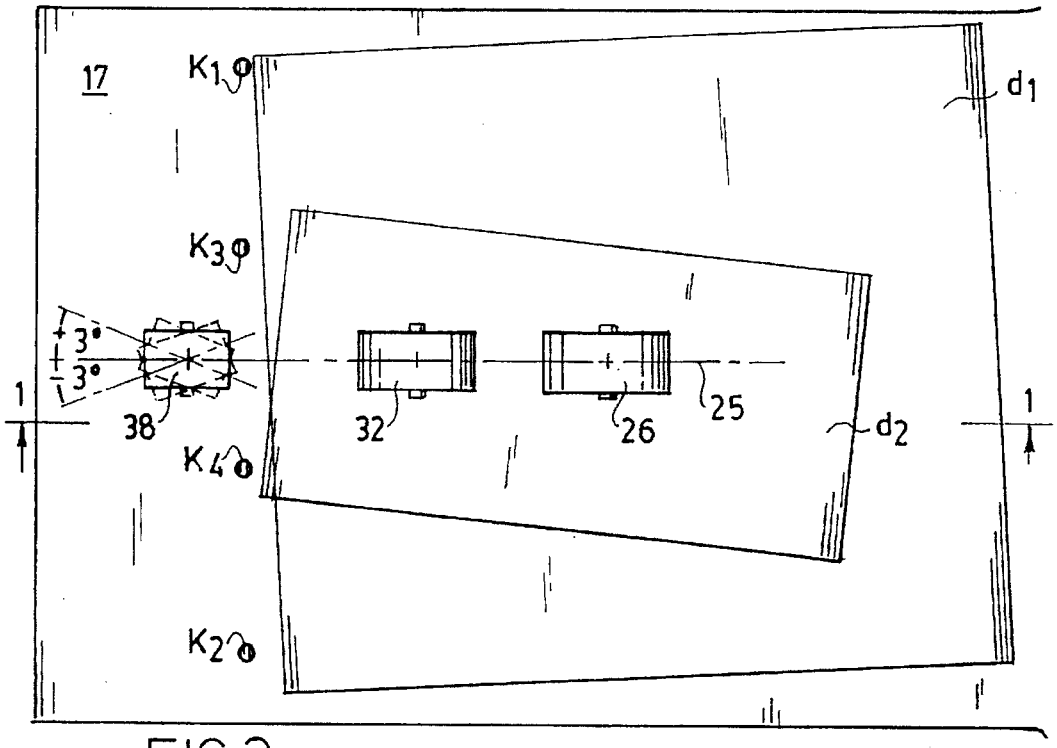
FIG. 2 is a schematic diagram of a plan view of the upper portion of the document flow path of the ADF shown in FIG. 1, this diagram showing only certain elements of the invention's document feed and skew control apparatus, the various parts being schematically represented in exaggerated and out-of-scale dimensions to facilitate clarity and understanding.

As can best be seen in FIG. 2, only a single row of in-line feed rollers are used to control document feed of both large engineering drawings (up to 36 inches wide) as well as more conventionally sized documents (e.g., 8½"×11" sheets). In the preferred embodiment shown in the drawings, it is assumed that engineering copier 12 is "center-registered" and, therefore, that ADF 10 has been designed to also operate in a center-registered manner, namely, with the center line 25 of the document drive feed rollers aligned with the center line of the document flow path. The general operation of this document drive mechanism is as follows:

A removable cassette 18 containing a stack of documents to be copied (not shown) is positioned in ADF 10 with its front lip 19 in proximity to a conventional retard pad 28 located at the entrance to the document flow path 17 of ADF 10. Cassette 18 includes a nudger plate 20 and a weighted roller 22 aligned, in this instance, with the center line of flow path 17. As indicated by arrow 24, when cassette 18 is positioned to permit its stack of documents to be fed through ADF 10, nudger plate 20 is spring-loaded upwardly against a nudger roller 26 which is selectively energized to feed documents into retard pad 28. A weighted arm 30, acting in combination with retard pad 28, separates the top document from the stack stored in cassette 18 as nudger roller 26 moves the top document into the nip between a conventional driver roller 32 and a brake roller 34. A drag force exerted by weighted roller 22 helps to maintain proper alignment of the top document during this initial feed movement out of cassette 18.

Also, in a manner well known in the art, as a document is being fed through the ADF, brake roller 34 is driven in a reverse direction through an override clutch (not shown). When only a single document is traveling through the nip shared with drive roller 32, the frictional forces created by drive roller 32, acting through the single document, are sufficient to overcome the override clutch so that brake roller 34 normally acts as an idler. Occasionally, as documents are being fed from the top of the stack in cassette 18, more than one document passes over retard pad 28 to enter the drive nip between drive roller 32 and brake roller 34 at the same time. Should this occur, the lower coefficient of friction between the multiple documents in the drive nip is no longer sufficient to allow drive roller 32 to overcome the bias of the override clutch driving brake roller 34, permitting the latter to rotate in a reverse direction to move all but the top document back out of the nip.

Drive roller 32 is rotated slightly faster than nudger roller 26, but the latter also includes an override clutch that permits the document being fed along flow path 17 to be moved at the speed of drive roller 32 while, at the same time, providing sufficient drag to keep the document straight and under tension. Finally, the document is moved into the nip between a take-away drive roller 36 and a take-away idler 38. Take-away drive roller 36 is driven by a stepper motor at a speed appropriate for entry of the document into the CVT of the associated engineering copy machine. The speed of take-away drive roller 36 is faster than the speed of drive roller 32, but the latter also has an overdrive clutch which permits the document to be pulled through at the speed determined by take-away drive roller 36.

As noted above, in those applications where document separation is not particularly difficult, it may be possible to omit either nudger roller 26/retard pad 28 or drive roller 32/brake roller 34.

When documents are being fed from ADF 10, a gate 40, positioned at the exit of document flow path 17, is opened to the position shown in dotted lines, allowing the document to be fed into the nips between CVT drive rollers 14, 16 (only partially shown) and two CVT idler rollers 42, 44. As indicated above, CVT drive rollers 14, 16 are essential elements of independent engineering copier 12 and, in the preferred embodiment shown in the drawings, CVT idler rollers 42, 44 are integral parts of our ADF 10.

Speed Control

As indicated above, our ADF is mechanically, but non-intrusively connected with the independent engineering copier to which it is attached so that documents passing through our ADF are delivered directly into the independent copier's CVT. That is, our ADF is not electrically connected to the independent copier and its controls. Therefore, it is essential that means be provided so that the ADF can operate in conformity with the latter's functions and speed. For instance, in some engineering copiers, the CVT is run in one direction to deliver the document being copied to the imaging station and, thereafter, the CVT is reversed to return the document to the operator along the same delivery path. Also, in most copiers, magnification or reduction of the image is accomplished (in the vertical direction) by increasing or decreasing the speed of the CVT. Such coordination with the independent copier is provided by the invention's speed control apparatus which senses the speed of the document as it is being delivered by the ADF and compares it to the speed and direction of the independent copier's CVT. Persons skilled in the art will appreciate that this document speed and direction information can be obtained in many ways which can vary with the level of accuracy required, and one possible closed-loop sensing system will now be described.

Figure 3:
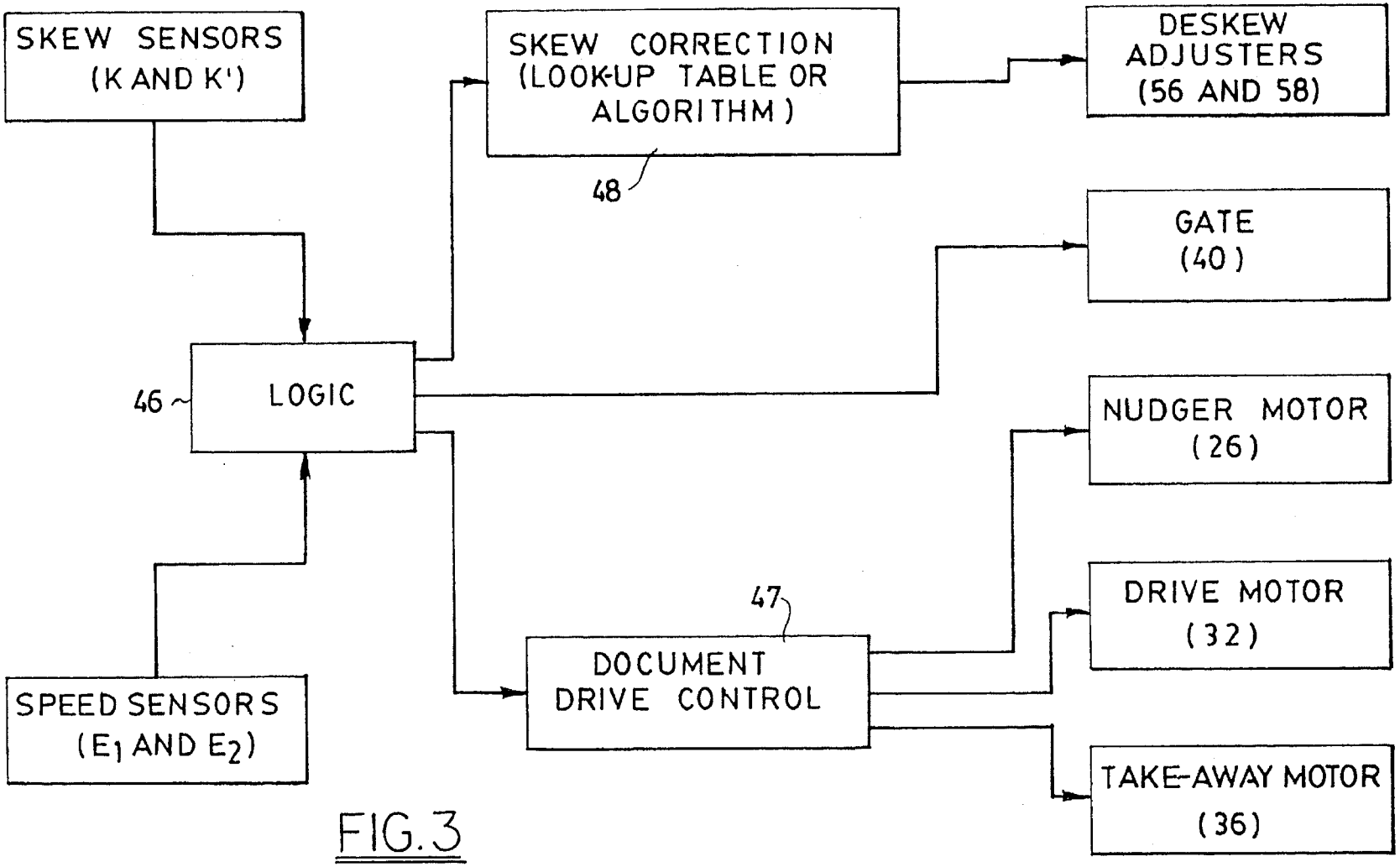
FIG. 3 is a block diagram of circuitry used (a) to operate the invention's document skew control apparatus, (b) to regulate the speed of the ADF's document drive apparatus, and (c) to coordinate the operation of the ADF with associated independent document processing machines.

Referring to FIGS. 1 and 3, once a document reaches CVT roller 42, an encoder $E_1$ senses the speed of CVT idler roller 42, and this speed is compared with the speed that the document is being fed by ADF 10. In the schematic representation shown in FIG. 1, document speed is determined by a second encoder $E_2$ which senses the rotation of nudger roller 26. As indicated above, while each preceding feed roller serves to hold the trailing portions of the document under tension, override clutches (not shown) permit these preceding rollers to be rotated at the speed of the leading portions of the document. (Since the length of flow path 17 between nudger roller 26 and idler roller 42 is less than the length of letter-size documents, encoder $E_2$ could just as well be located on another of the feed rollers or on a special roller that rides on the document.)

In any event, a logic circuit 46 first calculates and compares the speeds indicated by sensors $E_1$ and $E_2$, and then a document drive control circuit 47 varies the speed of the ADF's document drive rollers. In this preferred embodiment, the speed of a stepper motor rotating take-away drive roller 36 is adjusted until the speed of the document in ADF 10 (as determined in this arrangement by the rotation of nudger roller 26) is substantially equivalent to the speed of the CVT of copier 12 (as determined in this arrangement by the rotation of CVT idler 42). [NOTE: In this regard, it is preferable that the ADF drive remain slightly slower than the CVT drive at all times to maintain appropriate surface tension on the document.]

As just indicated above, since the CVT in many engineering copiers reverses the direction of the document being copied, encoder $E_1$ also notes such a directional change; and if the drive of CVT drive roller 14 is reversed to return documents, the feed mechanism of ADF 10 is stopped and gate 40 is closed, allowing the document to be returned through a space provided between ADF 10 and copier 12. In this regard, the default position of gate 40 is up (i.e., closed) to permit manual feed of copier 12 while ADF 10 is in standby mode.

Finally, encoder $E_1$ provides third and fourth informational inputs for logic circuitry 46. Namely, the initiation of its signal indicates that the leading edge of the document has reached CVT roller 14 of independent copier 12; and, for those independent copiers that return documents back through the CVT following imaging, the cessation of its signal indicates that the end of the document has left the CVT so that ADF 10 can begin to feed the next document in cassette 18.

While encoder $E_1$ is shown affixed to CVT idler roller 42, this first speed sensor might be provided instead in a different form, e.g., as a small encoder roller that forms a nip with the surface of the document at a position proximate to the location at which the document is engaged by the first CVT drive roller.

Skew Control

A primary feature of the just-described in-line center roller drive system is its ability to control skew, and this is accomplished as follows:

With specific reference to FIGS. 1, 2, and 3, positioned below document flow path 17, slightly upstream of take-away rollers 36 and 38, is a row of sensors $k_1$–$k_4$. Assuming that a large engineering drawing $d_1$ is being moved forward by drive roller 32 in the skewed orientation indicated, the leading edge of document $d_1$ is sensed by sensor $k_1$; and logic circuitry 46 initiates a timing circuit, ignores any intermediate signals from sensors $k_2$ and $k_3$, and awaits the signal from sensor $k_2$. As soon as the leading edge of document $d_1$ reaches sensor $k_2$, the elapsed time is delivered to skew correction circuitry 48 (comprising either a "look-up" table or an appropriate algorithm) and the deskew adjusters (i.e., solenoids 56 and 58, as explained in greater detail below) are appropriately activated to reorient take-away rollers 36 and 38 out of alignment with feed roller center line 25 in the plane of flow path 17 by a predetermined angle, e.g., +3° (i.e., clockwise).

The pressure on the nip between drive roller 32 and brake roller 34, which is sufficient to hold document $d_1$ lightly, acts as a pivot about which the leading edge of document $d_1$ is slightly rotated to the right to bring document $d_1$ into appropriate alignment. The +3°-off-center line orientation of take-away rollers 36, 38 is continued for a period of time selected by skew correction circuitry 48 (from the look-up table or determined by the algorithm) in accordance with the amount of skew initially noted by sensors $k_1$ and $k_2$.

Additional sensors (e.g., $k_3$ and $k_4$) similarly provide time-lapse information for controlling the skew of smaller documents. Referring to the example $d_2$ in FIG. 2, it is skewed to the right. Therefore sensor $k_4$ will note the leading edge of document $d_2$ before it will pass over sensor $k_3$. The skew control mechanism just explained above will again adjust the orientation of take-away rollers 36 and 38. However, in this instance, rollers 36 and 38 are positioned off-center by an angle of −3° (i.e., counterclockwise) and, again, for whatever time is determined according to the amount of skew indicated by the time lapse between the signals of sensors $k_3$ and $k_4$.

A second set of sensors $k'_1$–$k'_4$ are positioned a short distance upstream from gate 40 and the exit of flow path 17. Sensors $k'_1$–$k'_4$ work in the same manner as sensors $k_1$–$k_4$, as just described above, and take-away rollers 36 and 38 are again moved to an appropriate position (±3° off-center) for a period of time appropriate to overcome any small remaining skew of the leading edge of the document.

While the just-described skew sensing assembly uses two pair of sensors in each set, we have found that only a single pair of sensors is needed in each set, namely, $k_3$–$k_4$ and $k'_3$–$k'_4$, to provide accurate skew control appropriate for most feeding applications. Also, although the skew adjustment mechanism has just been described above as shifting both take-away rollers 36 and 38 ±3° off-center, we have found that for some applications appropriate skew control can be achieved by the shifting of only the upper take-away roller 36.

Figure 4:
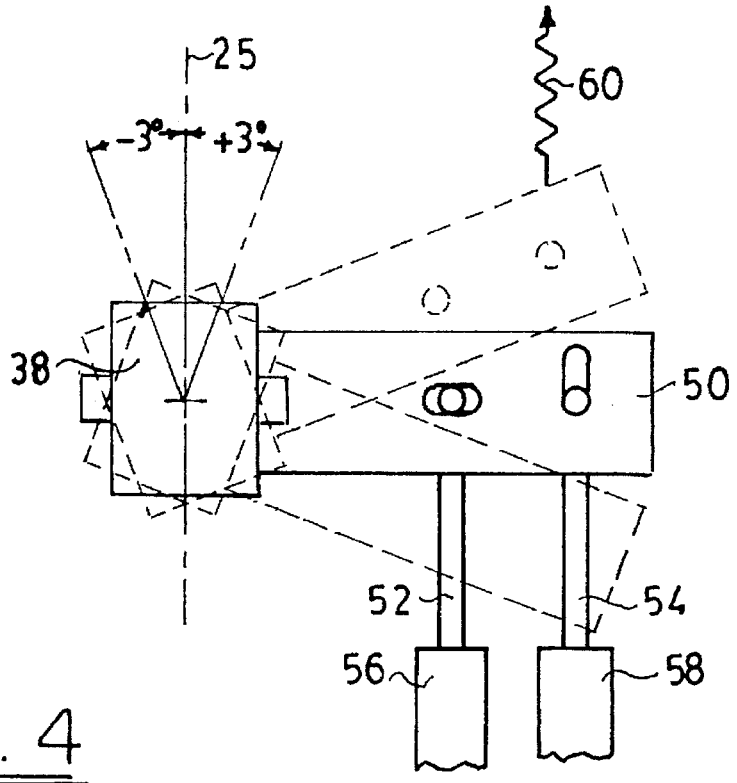
FIG. 4 is a schematic diagram of a plan view of a portion of a preferred embodiment of the invention's special skew adjustment system, showing mechanism for controlling the angular orientation of one of the ADF's take-away rollers with parts being schematically represented in exaggerated and out-of-scale dimensions to facilitate clarity and understanding.

Adjustment of the angular orientation of take-away rollers 36 and 38 is preferably controlled by a pair of respective solenoid-controlled lever arm assemblies, one of which is schematically illustrated in greatly exaggerated dimensions in FIG. 4. A spring-biased lever arm 50, fixed to the journal bearing of take-away roller 38, is slotted to receive the armatures 52, 54 of respective solenoids 56, 58. When ADF 10 is de-activated and solenoids 56, 58 are both de-energized, lever arm 50 is normally biased by spring 60 to a first position (indicated in FIG. 4 by the counterclockwise set of dotted lines). When ADF 10 is activated for feeding documents, solenoid 58 is energized, and armature 54 rotates lever arm 50 against the bias of spring 60 to the position shown in solid lines, namely, orienting take-away roller 38 in angular alignment with feed roller center line 25.

If the signals generated by the skew sensing assembly (just described above) indicate that the leading edge of a document is skewed counterclockwise, e.g., as indicated with document $d_1$ in FIG. 2, solenoid 56 is also energized. This causes armature 52 to rotate lever arm 50 further against the bias of spring 60 (i.e., clockwise in FIG. 4) to a second position which reorients take-away roller 38 angularly +3° relative to feed roller center line 25.

Contrarily, if the signals generated by the skew sensing assembly indicate that the leading edge of a document is skewed clockwise, e.g., as indicated with document $d_2$ in FIG. 2, solenoids 56, 58 are both de-energized, and lever arm 50 is rotated (counterclockwise in FIG. 4) by spring 60 to the third (uppermost) position indicated in dotted lines, reorienting take-away roller 38 angularly −3° relative to center line 25.

Occasionally, a document may be inadvertently loaded into cassette 18 with excessive skew (e.g., skewed more than 1" [2.5 cm]). Such excessive skew can result in document damage caused by the document corners being hung up in either the ADF or the independent copier. Therefore, in the event excessive skew is noted by sensors k, logic circuitry 46 shuts down the ADF drive before such damage can occur.

As indicated above, our ADF can also be used with "edge registered" document copiers. In that event, the just-described skew control apparatus may only be required to adjust skew in one direction in order to align the side of the document against the registration edge.

Also, the just-described speed- and skew-control circuitry also immediately senses any jam occurring in the ADF. If any of the skew sensors k or k' indicates the presence of a document in flow path 17 and, at the same time, either speed sensor $E_1$ or $E_2$ indicates that the document has stopped moving, document drive control 47 immediately stops take-over drive roller 36 as well as drive roller 32 and nudger roller 26, thereby minimizing damage to valuable engineering drawings.

Cassette

Figure 5:
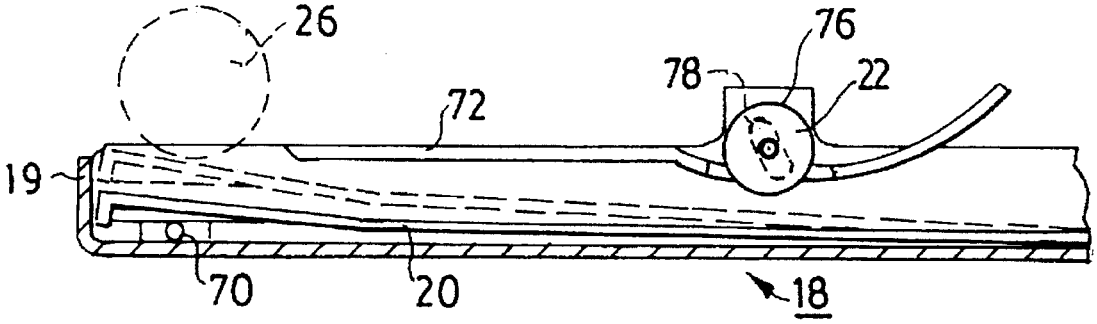
FIGS. 5 and 6 are schematic representations of the invention's cassette, FIG. 5 being an enlarged and partially cross-sectional side view of only the front portion of the cassette shown in plan view in FIG. 6.
Figure 6:
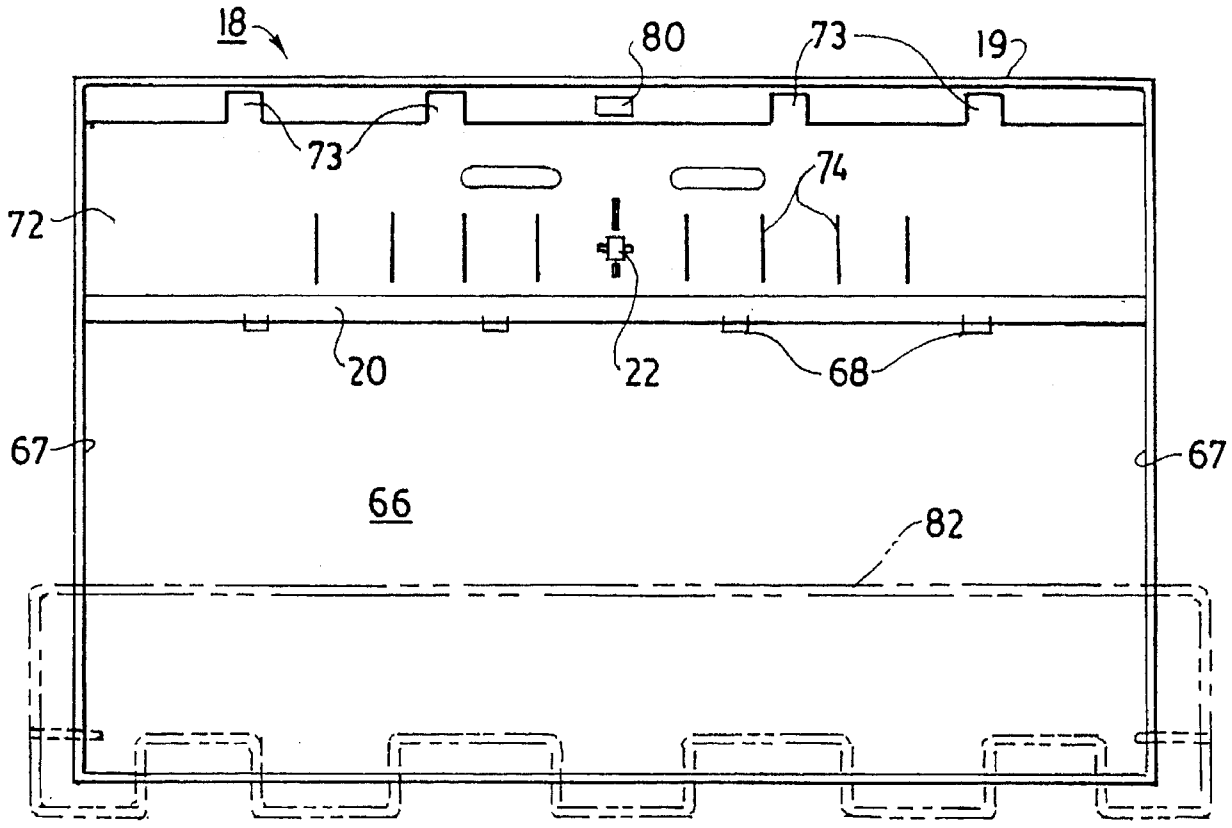

FIGS. 5 and 6 are very schematic representations of cassette 18. While FIG. 6 is a full plan view of the entire cassette, FIG. 5 shows an enlarged and partially cross-sectional side view of only the front portion of cassette 18.

Cassette 18 has a tray-like configuration, and its document receiving area 66, which is bounded by front lip 19 and respective sides 67, is quite large with a width coextensive with the width of flow path 17 (e.g., 36" [90 cm] wide) and with a predetermined length (e.g., 24" [60 cm] long). Cassette 18 is readied for loading by raising the rear of the cassette, tipping it several degrees higher than the angle shown schematically in FIG. 1. Since cassette 18 is quite large, this tipping action is assisted by springs (not shown). When such tipping occurs, nudger plate 20 is depressed into the retracted position indicated in solid lines in FIG. 5. Nudger plate 20, which is connected to the bottom of cassette 18 by appropriate hinges 68, is held in this retracted position by a magnetic latch 70.

As indicated above, cassette 18 can be loaded with documents while tipped up in ADF 10, or it can be removed from ADF 10 and loaded at a remote location, being held in its tipped-up orientation for loading in an appropriate stand. A cover 72 extends between sides 67 across the entire width of the front end of cassette 18. Extending from the forward edge of cover 72 are a plurality of spaced fingers 73 having tips that extend in proximity to front lip 19 so that, when a document is loaded into receiving area 66, the leading edge of the document can be viewed while being registered against front lip 19. Should the leading edge of a document be curled, spaced fingers 73 act to retain the curled leading edge in registration with front lip 19. The surface of cover 72 is also marked with guidelines 74 to facilitate centering the variously-sized engineering documents being stacked for processing.

Cover 72 is provided with an integral support frame 76 for mounting weighted roller 22 in a position intermediate sides 67 and in alignment with the document drive center line (i.e., feed roller center line 25 in FIG. 2) when cassette 18 is inserted in ADF 10 at the entry of flow path 17. The journals of weighted roller 22 are received in inclined slots 78. When cassette 18 is tipped up into its loading position, weighted roller 22 rolls up inclined slots 78 away from nudger plate 20 to allow space for stacking documents. The operator positions each document according to the guidelines marked on cover 72, placing its leading edge against the front lip 19 of cassette 18 and, depending upon the type of registration used by the independent copier to which ADF 10 is attached, centering each document or placing one of its side edges against one side of cassette 18.

When loading has been completed and cassette 18 is moved back into its operating position in ADF 10, weighted center roller 22 moves back down inclined slots 78 to rest upon the top document in the stack. Also, at the same time, nudger plate 20 is released by magnetic latch 70, moving under spring bias to press the top document in the stack against nudger roller 26. After all documents have been fed from cassette 18, a protective pad 80 (fixed to the front of nudger plate 20) rides against nudger roller 26.

For handling documents longer than receiving area 66, a wire frame 82 is snapped into appropriate mounting holes at the rear of the cassette. Documents longer than cassette 18 are draped over frame 82, while much longer documents are rolled and placed in the front section of frame 82, and then their leading edge is drawn under the front of frame 82 before being positioned against front lip 19 of cassette 18.

We claim:

1. Document feeder apparatus for a sheet-document processing machine, the latter having a constant velocity transport for transporting documents through said machine at predetermined speeds, said constant velocity transport having a drive roller mounted for rotation about a constant velocity transport roller axis, said document feeder apparatus comprising:

a document flow path oriented perpendicular to said constant velocity transport roller axis for defining a passageway for documents extending from an upstream entry through a downstream exit in proximity to said constant velocity transport;

a document drive for transporting a document along said flow path at predetermined speeds, said document drive comprising a single row of feed rollers centered for alignment along a line positioned parallel to said document flow path, said single row of feed rollers being arranged above and below said flow path and having:

at said flow path entry, one of (a) a single nudger roller associated with a retard pad and (b) a single drive roller forming a, nip with a brake roller;

a take-away roller forming a nip with a take-away idler; and an idler roller for forming a nip with the surface of a document moving along said flow path, said idler roller being located in proximity to said exit and to said constant velocity transport;

a document tray, positioned in alignment with said flow path at said upstream entry, for receiving documents for processing, said tray having a single weighted roller positioned in alignment with said feed roller center line;

a skew sensing assembly, with a set of sensors aligned across said flow path perpendicular to said feed roller center line at a position upstream of said take-away rollers, for producing a skew signal indicative of the amount of skew in the leading edge of a document moving along said flow path; and a skew adjustment mechanism responsive to said skew signal for (a) moving at least one of said take-away rollers from a first position in alignment with said feed roller center line to one of second and third positions in which said rollers are reoriented out of alignment with said feed roller center line in the plane of said flow path by a predetermined angle, said second and third positions being, respectively, in opposite directions relative to said feed roller center line, and (b) returning said take-away roller to said first position after a time interval determined by said skew signal.

2. The document feeder apparatus of claim 1 wherein said document drive has both said single nudger roller associated with said retard pad and said single drive roller forming a nip with said brake roller.

3. The document feeder apparatus of claim 1 wherein said document tray comprises a cassette, adapted to be removably positioned in alignment with said flow path and to receive a stack of documents.

4. The document feeder apparatus of claim 1 wherein, when said skew sensing assembly produces a skew signal indicative that the amount of skew in the leading edge of a document exceeds a predetermined limit, said document drive stops transporting said document along said flow path.

5. The document feeder apparatus of claim 1 wherein said skew sensing assembly further comprises:

a second set of sensors aligned across said flow path perpendicular to said feed roller center line at a position downstream of said take-away rollers, for producing a second skew signal indicative of the amount of skew in the leading edge of a document moving along said flow path at said downstream position; and wherein said skew adjustment mechanism is also responsive to said second skew signal for (a) moving at least one of said take-away rollers to one of said second and third positions, and (b) returning said take-away roller to said first position in alignment with said feed roller center line after a time interval determined by said second skew signal.

6. The document feeder apparatus of claim 5 wherein said skew adjustment mechanism further comprises:

a lever arm fixed to one of said take-away rollers, said lever arm being biased normally to hold said take-away roller in said second position;

a first adjuster for moving said lever arm to hold said take-away roller in said first position; and a second adjuster for moving said lever arm to hold said take-away roller in said third position.

7. The document feeder apparatus of claim 1 further comprising:

a first speed sensor for producing a signal indicative of the speed of said constant velocity transport;

a second speed sensor for producing a signal indicative of the speed of a document passing through said flow path;

a logic circuit for comparing said speed signals and for providing an output indicative of the difference between said speed signals produced by said first and second speed sensors; and said document drive being responsive to said speed comparison output for driving said document along said flow path at a speed that minimizes the difference between said speed sensor signals.

8. The document feeder apparatus of claim 1 wherein said feed roller center line is aligned along the center line of said document flow path.

9. An automatic document feeder for feeding documents to an independent document processing machine, the latter having a constant velocity transport for transporting documents through said machine at predetermined speeds, said constant velocity transport having a drive roller mounted for rotation about a constant velocity transport roller axis, said automatic document feeder comprising:

a document flow path oriented perpendicular to said constant velocity transport roller axis for defining a passageway for said documents extending from an upstream entry through a downstream exit in proximity to said constant velocity transport;

a document drive for transporting a document along said flow path at predetermined speeds, said document drive comprising a single row of feed rollers centered for alignment along a line positioned parallel to said document flow path, said single row of feed rollers being arranged above and below said flow path and having:

at said flow path entry, one of (a) a nudger roller associated with a retard pad and (b) a drive roller forming a nip with a brake roller;

a take-away roller forming a nip with a take-away idler; and an idler roller for forming a nip with the surface of a document moving along said flow path, said idler roller being located in proximity to said exit and to said constant velocity transport of said independent document processing apparatus; and a document tray, positioned in alignment with said flow path at said upstream entry, for receiving documents for processing, said tray having a single weighted roller positioned in alignment with said feed roller center line.

10. The document feeder of claim 9 wherein said document drive has both said single nudger roller associated with said retard pad and said single drive roller forming a nip with said brake roller.

11. The document feeder of claim 9 wherein said document tray comprises a cassette, adapted to be removably positioned in alignment with said flow path and to receive a stack of documents.

12. The document feeder of claim 11 wherein said cassette further comprises a nudger plate movable between (a) a retracted location whenever said cassette is being loaded and (b) an extended location in which it is biased against said nudger roller to facilitate delivery of documents.

13. The document feeder of claim 11 wherein said cassette further comprises a cover element marked with guidelines to facilitate proper centering of documents being loaded.

14. The document feeder of claim 13 wherein said cassette further comprises:

a document receiving area having a predetermined length and a width coextensive with the width of said flow path; and a document guide for receiving one end of documents having a length greater than said predetermined length of said receiving area.

15. The document feeder of claim 9 further comprising:

a skew sensing assembly, with a set of sensors aligned across said flow path perpendicular to said feed roller center line at a position upstream of said take-away rollers, for producing a skew signal indicative of the amount of skew in the leading edge of a document moving along said flow path; and a skew adjustment mechanism responsive to said skew signal for (a) moving at least one of said take-away rollers from a first position in alignment with said feed roller center line to one of second and third positions in which said roller is reoriented out of alignment with said feed roller center line in the plane of said flow path by a predetermined angle, said second and third positions being, respectively, in opposite directions relative to said feed roller center line, and (b) returning said take-away roller to said first position after a time interval determined by said skew signal.

16. The document feeder of claim 15 wherein, when said skew sensing assembly produces a skew signal indicative that the amount of skew in the leading edge of a document exceeds a predetermined limit, said document drive stops transporting said document along said flow path.

17. The document feeder of claim 15 wherein said skew sensing assembly further comprises:

a second set of sensors aligned across said flow path perpendicular to said feed roller center line at a position downstream of said take-away rollers, for producing a second skew signal indicative of the amount of skew in the leading-edge of a document moving along said flow path at said downstream position; and wherein said skew adjustment mechanism is also responsive to said second skew, signal for (a) moving at least one of said take-away rollers to one of said second and third positions, and (b) returning said take-away roller to said first position in alignment with said feed roller center line after a time interval determined by said second skew signal.

18. The document feeder of claim 9 further comprising:

a first speed sensor for producing a signal indicative of the speed of said constant velocity drive roller;

a second speed sensor for producing a signal indicative of the speed of a document passing through said flow path;

a logic circuit for comparing said speed signals and for providing an output indicative of the difference between said speed signals produced by said first and second speed sensors; and said document drive being responsive to said speed comparison output for driving said document along said flow path at a speed that minimizes the difference between said speed sensor signals.

19. The document feeder of claim 18 wherein said constant velocity transport of said independent document processing machine reverses direction of document transport through said independent machine during document processing, and wherein said first speed sensor also produces a signal indicative of the direction of said constant velocity transport and, when said direction signal indicates that said constant velocity transport is moving in a direction opposite to the downstream direction that documents are normally fed through said flow path, said document drive is deactivated.

20. The document feeder of claim 19 further comprising:

a gate positioned in proximity to said document flow path exit and upstream of said idler roller, said gate being movable, whenever said document drive is activated, from a retracted position closing said flow path exit to an open position allowing documents to move out of said flow path exit into said nip between said idler roller and the drive roller of said constant velocity transport of said independent document processing apparatus.

21. The document feeder of claim 20 wherein, when said direction signal indicates that said constant velocity drive roller is rotating in said opposite direction, said gate is moved to said retracted position.

22. The document feeder of claim 9 wherein said feed roller center line is aligned along the center line of said document flow path.

* * * * *